US011060317B2

(12) United States Patent
Kojima

(10) Patent No.: US 11,060,317 B2
(45) Date of Patent: Jul. 13, 2021

(54) TENT SHEET

(71) Applicant: Masaaki Kojima, Higashiomi (JP)

(72) Inventor: Masaaki Kojima, Higashiomi (JP)

( * ) Notice: Subject to any disclaimer, the term of this patent is extended or adjusted under 35 U.S.C. 154(b) by 0 days.

(21) Appl. No.: 16/657,280

(22) Filed: Oct. 18, 2019

(65) Prior Publication Data

US 2020/0217101 A1 Jul. 9, 2020

(30) Foreign Application Priority Data

Jan. 9, 2019 (JP) ..... JP2019-002238

(51) Int. Cl.
*E04H 15/54* (2006.01)

(52) U.S. Cl.
CPC ..... *E04H 15/54* (2013.01)

(58) Field of Classification Search
CPC ..... E04H 15/54; E04H 15/30; E04H 15/18; A45F 4/14
See application file for complete search history.

(56) References Cited

U.S. PATENT DOCUMENTS 197,878 A * 12/1877 Michaelis ..... E04H 15/30 135/95
794,036 A * 7/1905 McCall ..... E04H 15/18 135/97
872,404 A * 12/1907 Burch ..... E04H 15/30 135/95
928,391 A * 7/1909 Lukenbill ..... E04H 15/30 135/95
1,048,806 A * 12/1912 Burch ..... E04H 15/30 135/95
1,089,103 A * 3/1914 Barnard ..... E04H 15/30 135/95
1,260,612 A * 3/1918 Whall ..... E04H 15/30 135/95
1,895,911 A * 1/1933 Bosson, Jr. ..... A45F 4/14 2/89
2,268,317 A * 12/1941 Till ..... A45F 4/14 2/89
2,932,304 A * 4/1960 Voege ..... E04H 15/54 135/97
4,064,662 A * 12/1977 O'Toole ..... E04B 1/34357 52/71
5,769,106 A * 6/1998 Achuff ..... A41D 15/04 135/95

(Continued)

FOREIGN PATENT DOCUMENTS

JP H11-93462 A 4/1999
JP 2007-100459 A 4/2007
JP 2016-056599 A 4/2016

*Primary Examiner* — Noah Chandler Hawk
(74) *Attorney, Agent, or Firm* — United IP Counselors, LLC

(57) ABSTRACT

A tent sheet is disclosed. The tent sheet is in a rectangular shape having four vertices, two short sides, and two long sides, the tent sheet includes four straight-line diagonal tension reinforcement folding line parts provided corresponding to the four vertices. The four diagonal tension reinforcement folding line parts are each provided to extend from the midpoint or of the short side adjacent to a corresponding vertex of the vertices to a vertex side point which is nearer to the vertex than the midpoint of the long side adjacent to the vertex.

12 Claims, 6 Drawing Sheets

(56) References Cited

U.S. PATENT DOCUMENTS

| | | | | |
|---|---|---|---|---|
| 5,924,132 | A * | 7/1999 | Wigutow | A45F 4/14 2/69 |
| 9,267,308 | B2 | 2/2016 | Kojima | |
| 2010/0275961 | A1 | 11/2010 | Bell | |
| 2011/0179548 | A1 * | 7/2011 | Weston | A41D 3/08 2/84 |
| 2016/0121705 | A1 | 5/2016 | Taylor-Hughes | |

* cited by examiner

TENT SHEET

CROSS-REFERENCE TO RELATED APPLICATIONS

This application claims priority to Japanese Patent Application No. 2019-002238, filed Jan. 9, 2019, and is related to U.S. Design patent application No. 29/696,889, filed Jul. 2, 2019. Both of those applications are incorporated by reference herein in their entireties.

BACKGROUND OF THE INVENTION

1. Field of the Invention

The present invention relates to a tent sheet which has a single-piece simple shape and allows a tent to form an indoor space separated from the external space when the tent is set up.

2. Description of the Related Art

Various types of tents are available to meet users' tastes for example with respect to comfort and handiness. Among the various types, handy tents which can be stored in a compact manner have been suggested. For example, Japanese Patent Application Publication No. 2007-100459 discloses a tent which includes a single-piece square tent sheet, two extendable poles, and a frame, so that the tent can be folded and stored in a compact manner and carried.

SUMMARY OF THE INVENTION

The tent sheet in a single-piece simple shape as disclosed in Japanese Patent Application Publication No. 2007-100459 is convenient for its storability and damage resistance. However, the tent having the tent sheet disclosed in Japanese Patent Application Publication No. 2007-100459 does not form an indoor space (inside space) separated from the external space. In general, a tent is often desired to form an indoor space separated from the external space.

With the foregoing in view, it is an object of the present invention to provide a tent sheet in a single-piece simple shape which allows a tent to form an indoor space separated from the external space when the tent is set up.

In order to achieve the object, a tent sheet according to an embodiment of the present invention is a tent sheet in a rectangular shape having four vertices, two short sides, and two long sides, the tent sheet including a straight-line diagonal tension reinforcement folding line part provided corresponding to each of the four vertices, the diagonal tension reinforcement folding line part being provided to extend from a midpoint of a short side adjacent to a corresponding vertex of the vertices to a vertex side point, wherein the vertex side point is nearer to a corresponding vertex than a midpoint of a long side adjacent to the corresponding vertex.

In the tent sheet described above, a distance from the midpoint of the short side adjacent to the vertex corresponding to the diagonal tension reinforcement folding line part to the vertex may be longer than a distance from the vertex side point of the long side adjacent to the vertex to the vertex.

In the tent sheet described above, an additional diagonal tension reinforcement folding line part may be provided corresponding to each of the four vertices, wherein a vertex side point of the additional diagonal tension reinforcement folding line part is located at a position different from the vertex side point of the diagonal tension reinforcement folding line part.

The tent sheet described above may further include a straight-line central tension reinforcement folding line part, and the straight-line central tension reinforcement folding line part may be formed by connecting the midpoints of the two short sides.

The tent sheet described above may further include a straight-line transverse tension reinforcement folding line part, and the transverse tension reinforcement folding line part may be provided on a line connecting two of the vertex side points.

The tent sheet described above may further include a peripheral part which is symmetric with respect to the midpoint of the short side and is provided outward from the short side.

The tent sheet according to the present invention has a single-piece simple shape and allows a tent to form an indoor space separated from the external space when the tent is set up.

DETAILED DESCRIPTION

Figure 1:
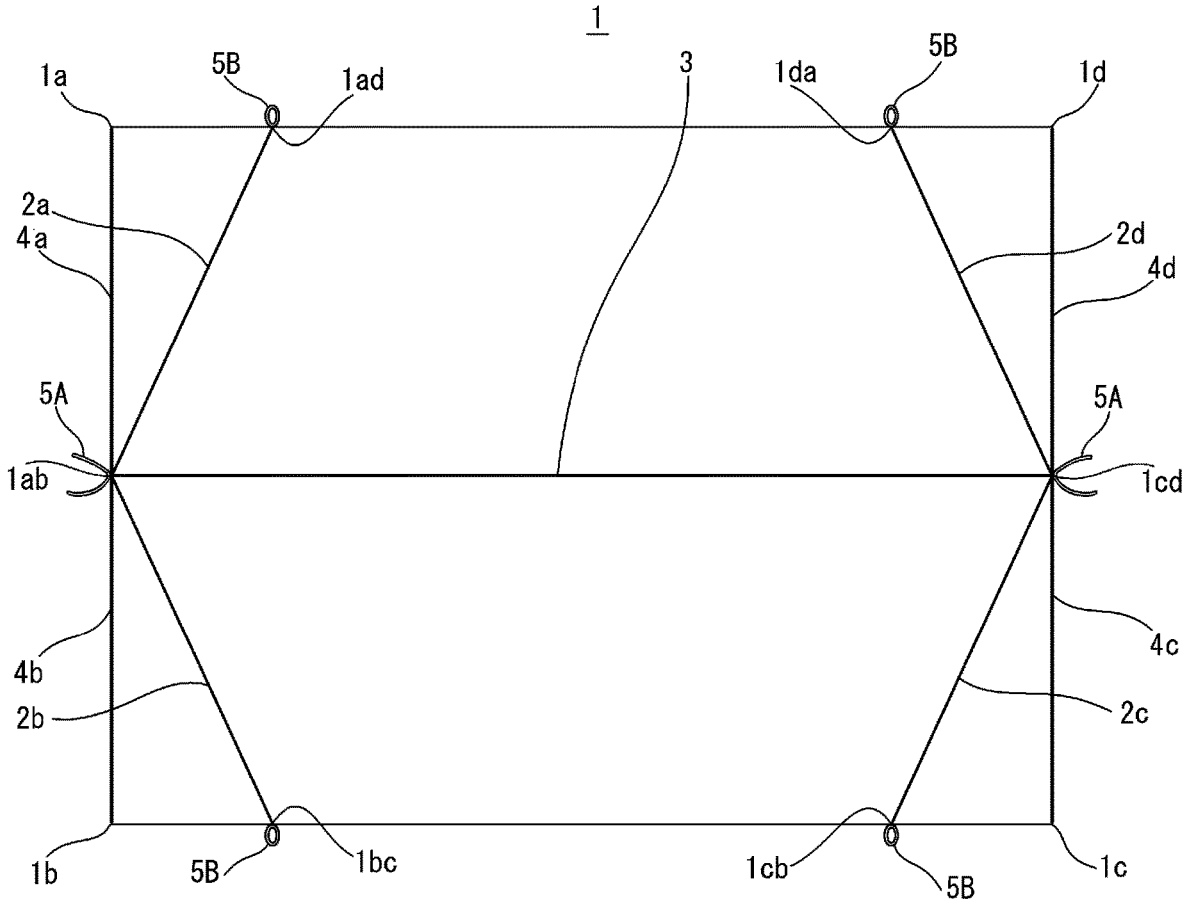
FIG. 1 is a plan view of a tent sheet according to an embodiment of the present invention.
Figure 2:
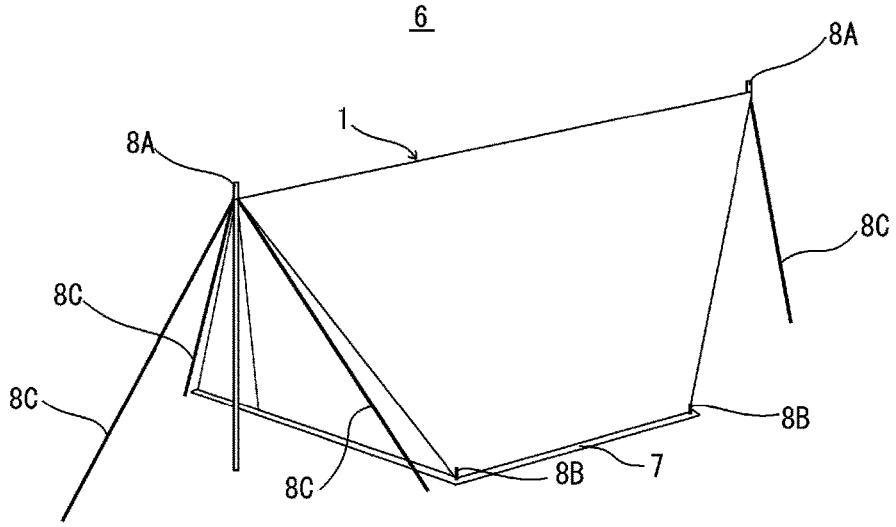
FIG. 2 is a perspective view of a tent having the tent sheet shown in FIG. 1.

Hereinafter, an embodiment of the present invention will be described. As shown in FIG. 1, a tent sheet 1 according to the embodiment of the present invention has a rectangular shape having four vertices 1*a*, 1*b*, 1*c*, and 1*d*. According to the embodiment, the segment between the vertices 1*a* and 1*b* and the segment between the vertices 1*c* and 1*d* are the short sides of the rectangular shape, and the segment between vertices 1*d* and 1*a* and the segment between the vertex 1*b* and 1*c* are the long sides of the rectangular shape. The size of the tent sheet 1 is not particularly limited. As for the appropriate size, the short side of the rectangular shape may be about 2.8 m and the long side may be about 3.8 m considering its specific ratio with respect to the human body size. Using the tent sheet 1, a tent 6 as shown in FIG. 2 can be set up. The base material of the tent sheet 1 may be a synthetic resin such as polyester similarly to generally available tent sheets. The tent sheet 1 of the tent 6 is deployed in a state shown in FIGS. 3A, 3B, and 3C.

As shown in FIG. 1, the tent sheet 1 includes straight-line diagonal tension reinforcement folding line parts 2*a*, 2*b*, 2*c*, and 2*d* corresponding to the four vertices 1*a*, 1*b*, 1*c*, and 1*d*, respectively. The tent sheet 1 is also provided with a straight-line central tension reinforcement folding line part 3. When the tent 6 is set up, the tent sheet 1 is allowed or expected to be folded along the straight-line diagonal tension reinforcement folding lines 2*a*, 2*b*, 2*c*, and 2*d* and the central tension reinforcement folding line part 3, and these parts are under tension so that the shape of the tent 6 is maintained and reinforced with reinforcement members to withstand the tension. The reinforcement members may be of the same material as the base material of the tent sheet 1 or a different material arranged in a straight-line strip shape and fixed to the base material or may be strings stitched to the base material in a straight-line shape (including a straight-line strip shape). Note that the reinforcement members are preferably not too hard in consideration of the storability.

The diagonal tension reinforcement folding line part 2*a* is provided to extend from the midpoint 1*ab* of the short side adjacent to the vertex 1*a* to a vertex side point 1*ad* which is nearer to the vertex 1*a* than the midpoint of the long side adjacent to vertex 1*a*, the diagonal tension reinforcement folding line part 2*b* is provided to extend from the midpoint 1*ab* of the short side adjacent to the vertex 1*b* to a vertex side point 1*b* c which is nearer to the vertex 1*b* than the midpoint of the long side adjacent to the vertex 1*b*, the diagonal tension reinforcement folding line part 2*c* is provided to extend from the midpoint 1*cd* of the short side adjacent to the vertex 1*c* to a vertex side point 1*cb* which is nearer to the vertex 1*c* than the midpoint of the long side adjacent to the vertex 1*c*, and the diagonal tension reinforcement folding line part 2*d* is provided to extend from the midpoint 1*cd* of the short side adjacent to the vertex 1*d* to a vertex side point 1*d* a which is nearer to the vertex 1*d* than the midpoint of the long side adjacent to the vertex 1*d*.

Preferably, the distance from the midpoint 1*ab* of the short side adjacent to the vertex 1*a* to the vertex 1*a* corresponding to the diagonal tension reinforcement folding line part 2*a* is longer than the distance from the vertex side point 1*ad* of the long side adjacent to the vertex 1*a* to the vertex 1*a*, the distance from the midpoint 1*ab* of the short side adjacent to the vertex 1*b* to the vertex 1*b* corresponding to the diagonal tension reinforcement folding line part 2*b* is longer than the distance from the vertex side point 1*b* c of the long side adjacent to the vertex 1*b* to the vertex 1*b*, the distance from the midpoint 1*cd* of the short side adjacent to the vertex 1*c* to the vertex 1*c* corresponding to the diagonal tension reinforcement folding line part 2*c* is longer than the distance from the vertex side point 1*cb* of the long side adjacent to the vertex 1*c* to the vertex 1*c*, and the distance from the midpoint 1*cd* of the short side adjacent to the vertex 1*d* to the vertex 1*d* corresponding to diagonal tension reinforcement folding line part 2*d* is longer than the distance from the vertex side point 1*d* a of the long side adjacent to the vertex 1*d* to the vertex 1*d*. This is for the purpose of securing a sufficient height H for the tent sheet 1 of the tent 6 (and therefore a sufficient height for the indoor space) (see FIG. 3B) with respect to the width W of the tent sheet 1 of the tent 6 (and therefore the width of the indoor space) (see FIG. 3B), so that a certain degree of comfort can be easily provided to the user in the indoor space.

The central tension reinforcement folding line part 3 is formed by connecting the midpoints 1*ab* and 1*cd* of the two short sides (the short side between the vertices 1*a* and 1*b* and the short side between the vertices 1*c* and 1*d*).

Normally, connecting members 4*a* and 4*b*, which can be mutually contacted and connected, are provided. The connecting members 4*a* is provided between the midpoint 1*ab* and the vertex 1*a*. The connecting members 4*b* is provided between the midpoint 1*ab* and the vertex 1*b*. The connecting members 4*a* and 4*b* form for example a Hook-and-Loop fastener or a zip fastener. Connecting members 4*c* and 4*d* identical to the connecting members 4*a* and 4*b* are normally provided between the midpoint 1*cd* and the vertex 1*c* and between the midpoint 1*cd* and the vertex 1*d*, respectively.

Coupling members (such as strings) 5A, 5A are normally provided in the vicinity of the midpoints 1*ab* and 1*cd* to couple the tent sheet to poles 8A, 8A (which will be described) when the tent 6 having the tent sheet 1 is set up. Coupling members (such as ring-shaped strings) 5B, 5B, . . . are normally provided in the vicinity of the vertex side points 1*ad*, 1*b* c, 1*c* b, and 1*d* a to couple the tent sheet 1 to pegs 8B, 8B, . . . (which will be described) when the tent 6 having the tent sheet 1 is set up.

The tent 6 having the tent sheet 1 can be set up in the following manner. To start with, a floor sheet 7 is spread on the ground. Then, the four diagonal tension reinforcement folding line parts 2*a*, 2*b*, 2*c*, and 2*d* and the central tension reinforcement folding line part 3 are mountain-folded (see FIG. 3A). Then, the part from the midpoint 1*ab* to the vertex 1*a* and the part from the midpoint 1*ab* to the vertex 1*b* can be contacted with each other (see FIG. 3B), while the part from the midpoint 1*cd* to the vertex 1*c* and the part from the midpoint 1*cd* to the vertex 1*d* can be contacted with each other. It should be noted that the part from the vertex side point 1*ad* to the vertex 1*a* and the part from the vertex side point 1*b* c to the vertex 1*b* can be aligned and brought into contact with the floor sheet 7 and the part from vertex side point 1*cb* to the vertex 1*c* and the part from the vertex side point 1*d* a to the vertex 1*d* cab be aligned and brought into contact with the floor sheet 7.

Then, the part from the midpoint 1*ab* to the vertex 1*a* and the part from the midpoint 1*ab* to the vertex 1*b* can be connected with each other by the connecting members 4*a* and 4*b*, and the part from the midpoint 1*cd* to the vertex 1*c* and the part from the midpoint 1*cd* to the vertex 1*d* can be connected with each other by the connecting members 4*c* and 4*d*, so that a closed indoor space (inside space) can be provided using the tent sheet 1. The connected part of these members may be used as an exit/entrance from/to the tent 6. Although not shown, the tent sheet 1 and the floor sheet 7 can be fixed by a known method. Note that the floor sheet 7 may be in a rectangular shape or any other shape or may be formed integrally with the tent sheet 1.

The two poles 8A, 8A are set upright on the left and right sides of the tent 6 on the ground and kept stable using wires 8C, 8C, . . . the coupling members 5A, 5A are coupled and fixed to the tops of the poles 8A, 8A, and the pegs 8B, 8B, . . . are coupled with the coupling members 5B, 5B, . . . and fixed to the ground. In this manner, the tent 6 having the tent sheet 1 is set up, and the tent sheet 1 has a trapezoidal shape in a front view as shown in FIG. 3C in which the lower base is shorter than the upper base and a triangular shape in a left side view and a right side view as shown in FIG. 3B. The uppermost part of the tent 6 having the tent sheet 1 corresponds to the midpoints 1*ab* and 1*cd* and the central tension reinforcement folding line part 3 connecting these midpoints. The exit/entrance of the tent 6 extends inward in the downward direction from the midpoint 1*ab* (or 1*cd*) as the uppermost part of the tent 6. Note that in FIGS. 3A, 3B, and 3C (and in FIGS. 6A, 6B, 6C, and 8 which will be described), the coupling members 5A, 5A are in an untied state (with no knot formed) for convenience of illustration.

As described above, the tent sheet 1 has a single-piece simple shape and still allows the tent 6 to form an indoor space separated from the external space when the tent is set up. Note that the central tension reinforcement folding line part 3 may be omitted in some cases though the uppermost shape of the tent 6 having the tent sheet 1 may change more easily upon rain and wind.

The tent sheet 1 having a single-piece simple shape is convenient for its high storability and damage resistance. When stored, the tent sheet can be rolled or folded.

The tent sheet 1 described above may be additionally provided with further members and parts as shown in the following examples. Note that the following examples can be applied to each other.

Figure 4:
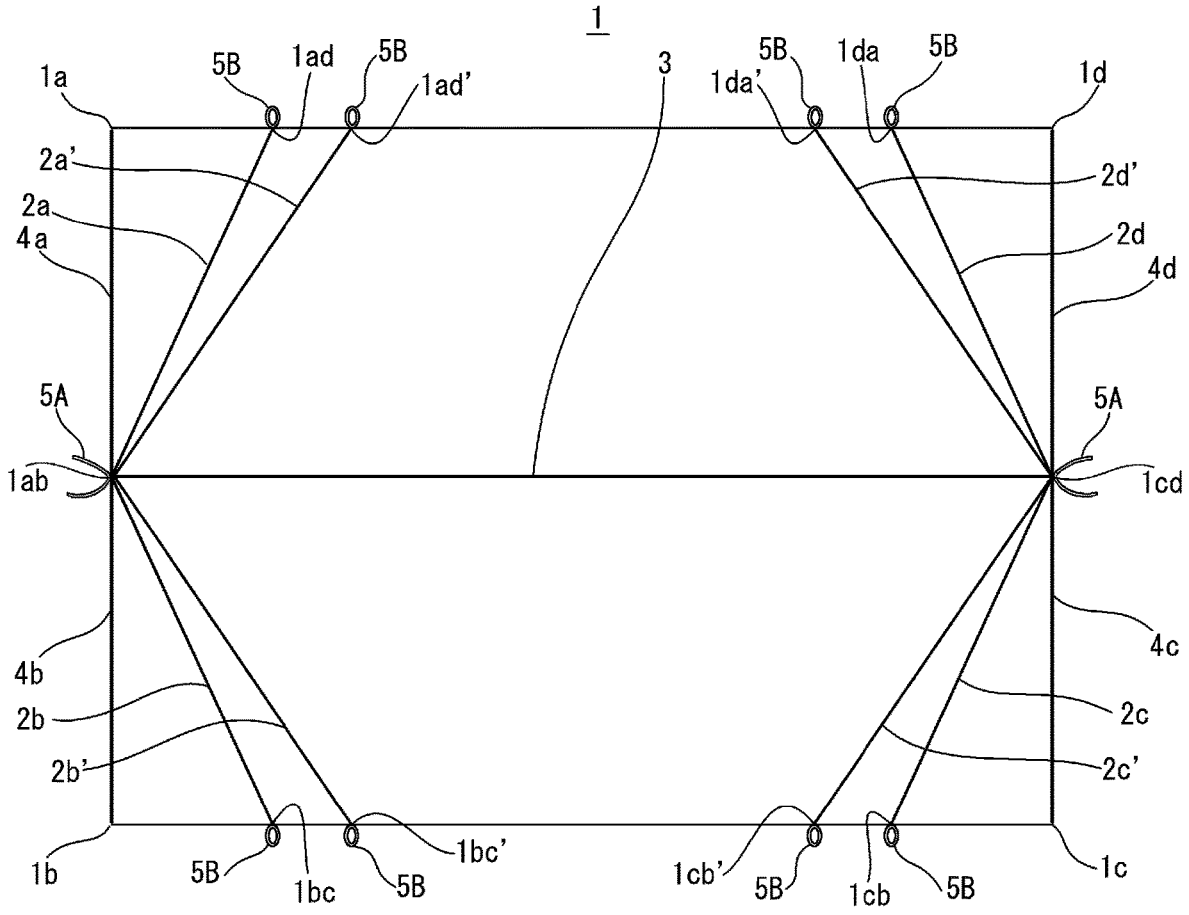
FIG. 4 is a plan view of the tent sheet provided with a plurality of diagonal tension reinforcement folding line parts.

The tent sheet 1 may have a plurality of such diagonal tension reinforcement folding line parts corresponding to the vertices 1*a*, 1*b*, 1*c*, and 1*d*, wherein the vertex side points are located at different positions. More specifically, as shown in FIG. 4, the tent sheet 1 may be provided with diagonal tension reinforcement folding line parts 2*a*', 2*b*', 2*c*', and 2*d*' in addition to the diagonal tension reinforcement folding line parts 2*a*, 2*b*, 2*c*, and 2*d* corresponding to the vertices 1*a*, 1*b*, 1*c*, and 1*d*. The positions of the vertex side points 1*ad*', 1*bc*', 1*cb*' and 1*da*' of the diagonal tension reinforcement folding line parts 2*a*', 2*b*', 2*c*', and 2*d*' are different from those of the vertex side points 1*ad*, 1*bc*, 1*cb*, and 1*da* of the diagonal tension reinforcement folding line parts 2*a*, 2*b*, 2*c*, and 2*d*. Further diagonal tension reinforcement folding line parts may be added to the diagonal tension reinforcement folding line parts 2*a*, 2*b*, 2*c*, and 2*d* and the diagonal tension reinforcement folding line parts 2*a*', 2*b*', 2*c*', and 2*d*'.

In this manner, the ratio between the width W (and therefore the width of the indoor space) of the tent sheet 1 of the tent 6 (see FIG. 3B) and the height H (and therefore the height of the indoor space) of the tent sheet 1 of the tent 6 (see FIG. 3B) can be changed depending upon the situation related to a human, luggage or external environment. For example, the tent sheet 1 of the tent 6 having the diagonal tension reinforcement folding line parts 2*a*', 2*b*', 2*c*', and 2*d*' mountain-folded has a smaller height H and a greater width W than the tent sheet 1 of the tent 6 having the diagonal tension reinforcement folding line parts 2*a*, 2*b*, 2*c*, and 2*d* mountain folded.

Figure 5:
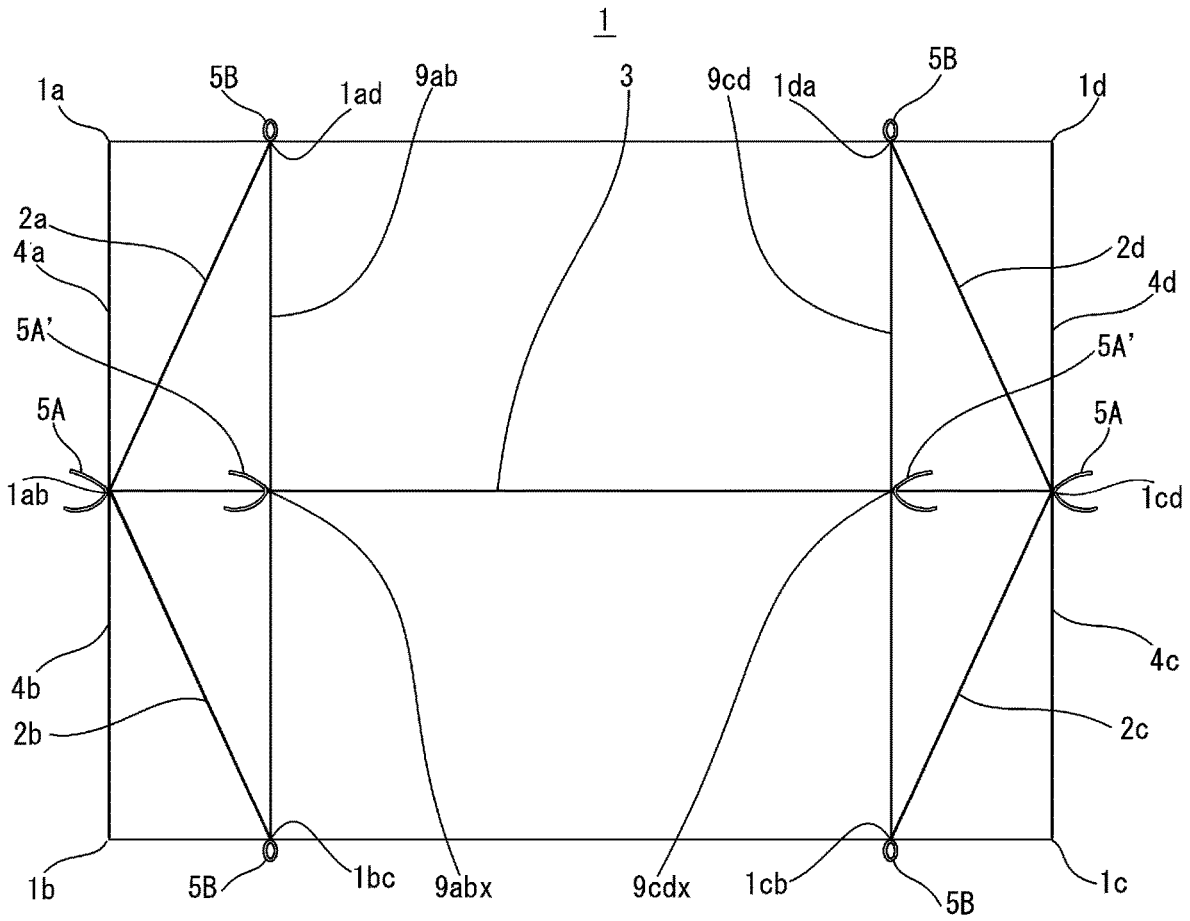
FIG. 5 is a plan view of the tent sheet provided with transverse tension reinforcement folding line parts.

As shown in FIG. 5, the tent sheet 1 may be provided with straight-line shaped, transverse tension reinforcement folding line parts 9*ab* and 9*cd*. The transverse tension reinforcement folding line part 9*ab* is provided on a line connecting the vertex side point 1*ad* and the vertex side point 1*b* c, while the transverse tension reinforcement folding line part 9*cd* is provided on a line connecting the vertex side point 1*cb* and the vertex side point 1*da*. The transverse tension reinforcement folding line parts 9*ab* and 9*cd* may be provided with reinforcement members identical to the reinforcement members for the four diagonal tension reinforcement folding line parts 2*a*, 2*b*, 2*c*, and 2*d* (and 2*a*', 2*b*', 2*c*', and 2*d*') and the central tension reinforcement folding line part 3. In FIG. 5, the crossing points between the transverse tension reinforcement folding line parts 9*ab* and 9*cd* and the central tension reinforcement folding line part 3 are designated by 9*abx* and 9*cdx*. Coupling members 5A', 5A' (such as strings) are normally provided in the vicinity of the crossing points 9*abx* and 9*cdx*.

Figure 3A:
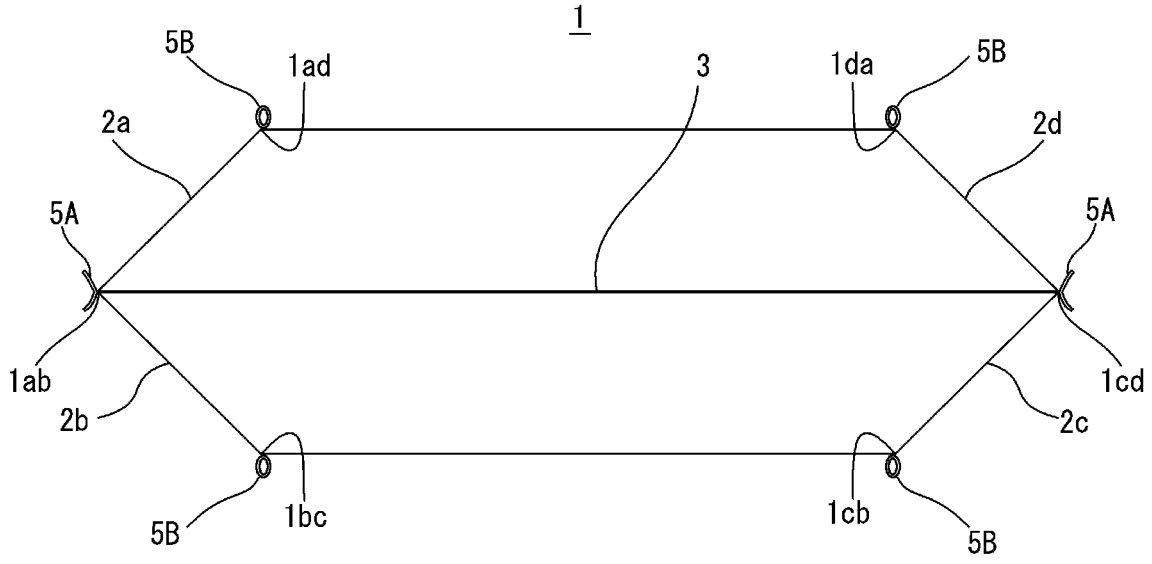
FIGS. 3A, 3B, and 3C are respectively a plan view, a left side view, and a front view of the tent sheet when the tent shown in FIG. 2 is set up.
Figure 3B:
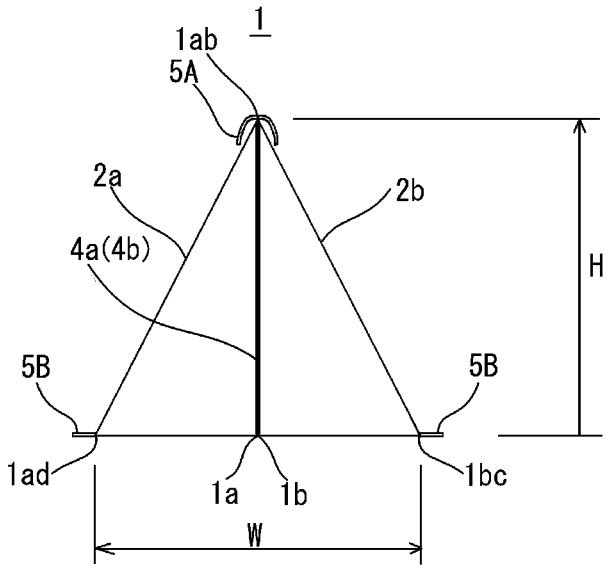
Figure 3C:
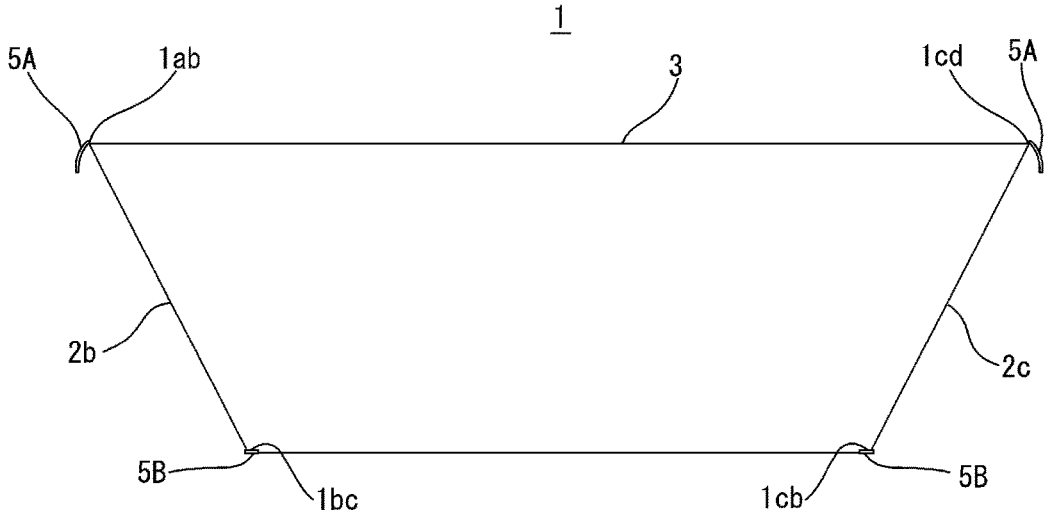
Figure 6A:
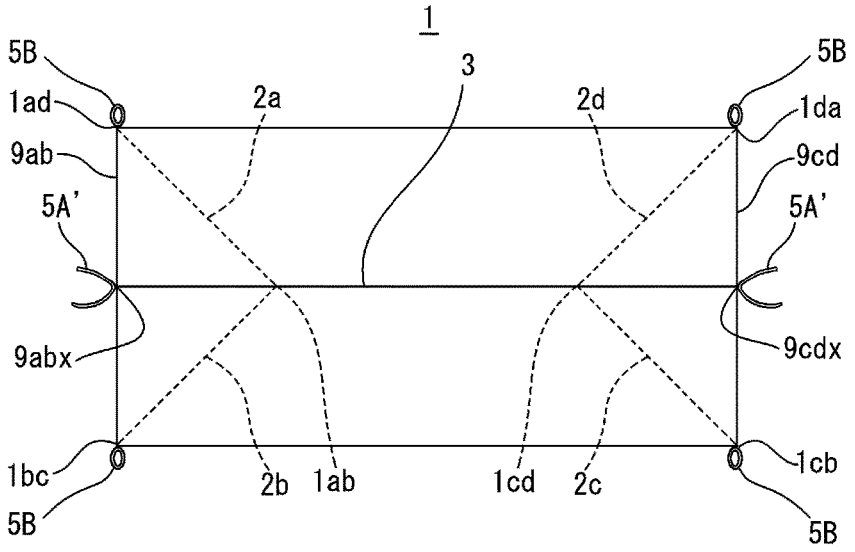
FIGS. 6A, 6B, and 6C are respectively a plan view, a left side view, and a front view of the tent sheet when the tent is set up while the transverse tension reinforcement folding line part of the tent sheet shown in FIG. 5 is mountain-folded.
Figure 6B:
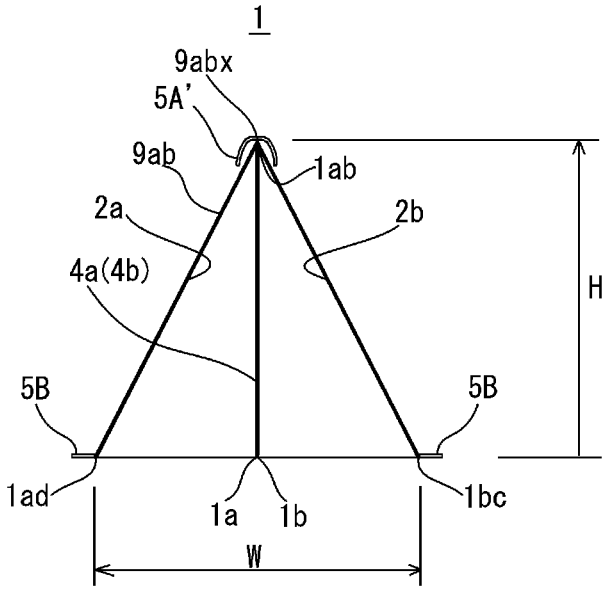
Figure 6C:
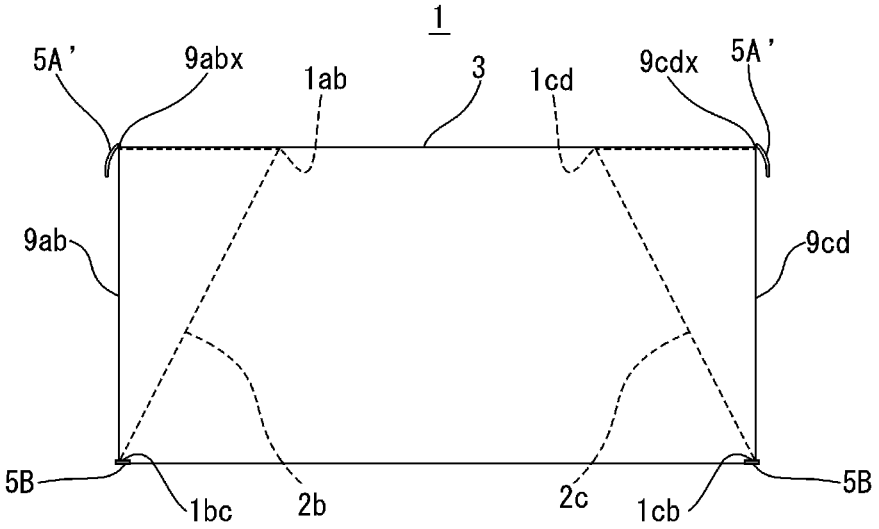

In this manner, the tent sheet 1 of the tent 6 may be deployed in the state shown in FIGS. 6A, 6B, and 6C in addition to the state shown in FIGS. 3A, 3B, and 3C. In order to deploy up the tent sheet in the state shown in FIGS. 6A, 6B, and 6C, the transverse tension reinforcement folding line parts 9*ab* and 9*cd* and the central tension reinforcement folding line part 3 are mountain-folded, and the four diagonal tension reinforcement folding line parts 2*a*, 2*b*, 2*c*, and 2*d* are valley-folded (see FIG. 6A). In this manner, similarly to the above (as described in conjunction with FIGS. 3A, 3B, and 3C), the part from the midpoint 1*ab* to the vertex 1*a* and the part from the midpoint 1*ab* to the vertex 1*b* may be contacted with each other (see FIG. 6B), while the part from the midpoint 1*cd* to the vertex 1*c* and the part from the midpoint 1*cd* to the vertex 1*d* may be contacted with each other. At the time, the part from the vertex side point 1*ad* to the vertex 1*a* and the part from the vertex side point 1*bc* to the vertex 1*b* may be aligned and brought into contact with the floor sheet 7, and the part from the vertex side point 1*cb* to the vertex 1*c* and the part from the vertex side point 1*da* to the vertex 1*d* may be aligned and brought into contact with the floor sheet 7.

In this manner, similarly to the above (as described in conjunction with FIGS. 3A, 3B, and 3C), the part from the midpoint 1*ab* to the vertex 1*a* and the part from the midpoint 1*ab* to the vertex 1*b* can be connected with each other by the connecting members 4*a* and 4*b*, and the part from the midpoint 1*cd* to the vertex 1*c* and the part from the midpoint 1*cd* to the vertex 1*d* can be connected with each other by the connecting members 4*c* and 4*d*, so that an indoor space (an inside space) closed using the tent sheet 1 can be formed. These connecting parts may serve as the entrance/exit to/from the tent 6.

The coupling members 5A', 5A' are connected and fixed to the two poles 8A, 8A. Otherwise, the method for setting up the tent 6 is the same as the above (as described in conjunction with FIGS. 3A, 3B, and 3C). The uppermost part of the tent 6 having the tent sheet 1 corresponds to the crossing points 9*abx* and 9*cdx* and the central tension reinforcement folding line 3 therebetween. The entrance/exit of the tent 6 extends outward in the downward direction from the midpoint 1*ab* (or 1*cd*) positioned inside.

In the state shown in FIGS. 6A, 6B, and 6C, the external area (the area in contact with the external space) decreases, which increases the capability of withstanding a strong wind or the like.

Figure 7:
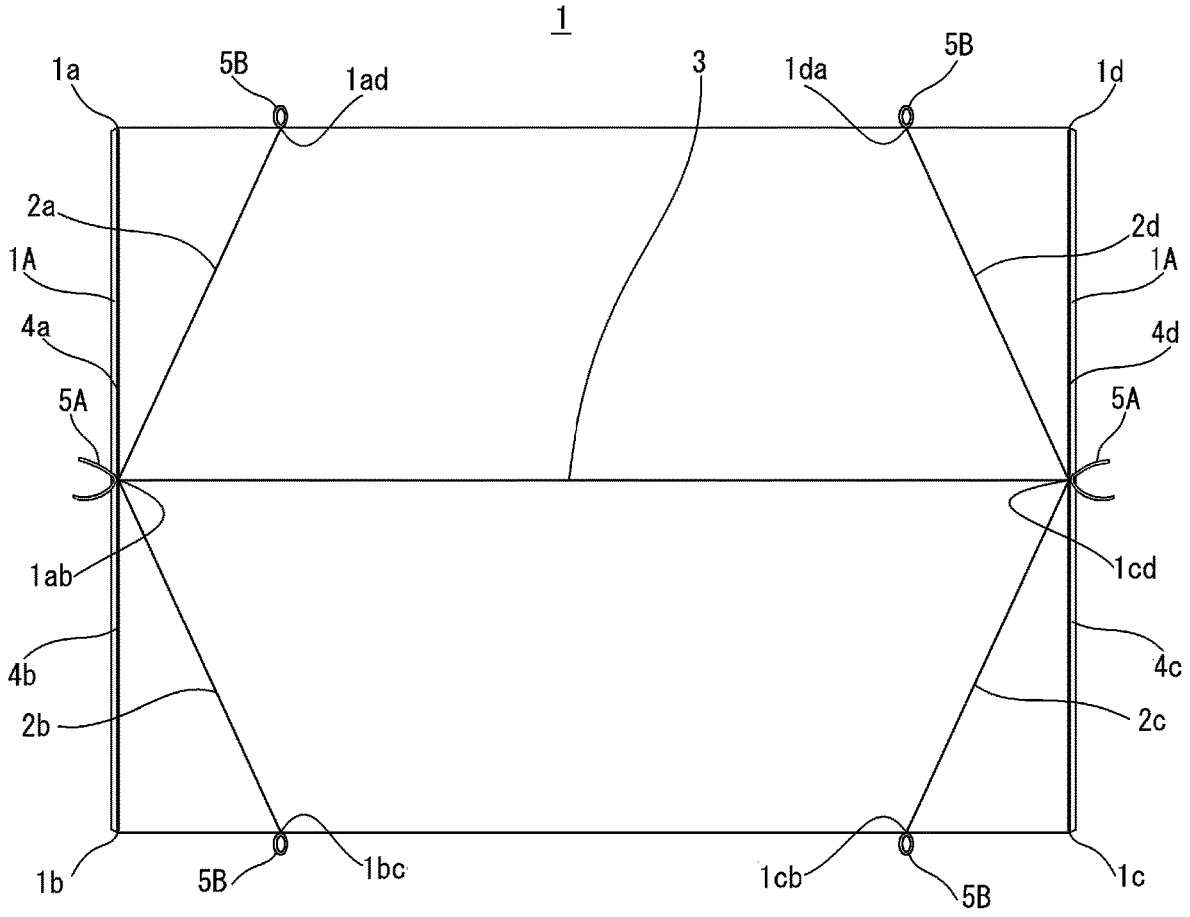
FIG. 7 is a plan view of the tent sheet additionally provided with peripheral parts.

As shown in FIG. 7, the tent sheet 1 may further have peripheral parts 1A, 1A which are symmetric with respect to the midpoint 1*ab* or 1*cd* at the outer side of each of the two short sides (the short side between the vertices 1*a* and 1*b* and the short side between the vertices 1*c* and 1*d*). As shown in FIG. 7, the peripheral part 1A may have a strip shape. Note that in FIG. 7, the ends of the peripheral parts 1A, 1A in the vicinity of the vertices 1*a*, 1*b*, 1*c*, and 1*d* are oblique.

Figure 8:
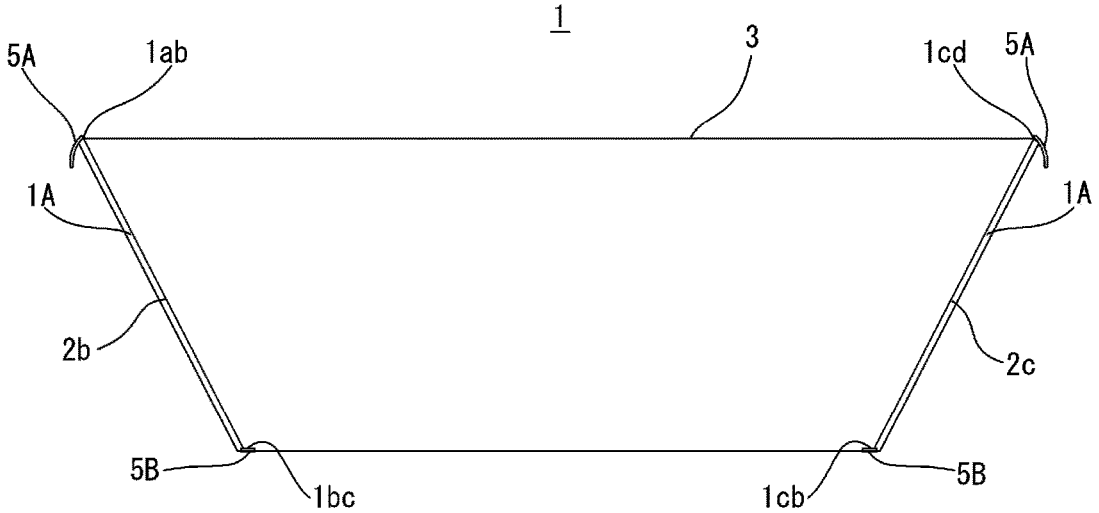
FIG. 8 is a front view of the tent sheet shown in FIG. 7 when the tent having the tent sheet is set up.

As shown in FIG. 8, when the tent 6 having the tent sheet 1 provided with the peripheral parts 1A, 1A is set up, the two short sides are valley-folded and their center parts are mountain-folded, the part from the midpoint 1*ab* to the vertex 1*a* and the part from the midpoint 1*ab* to the vertex 1*b* are in contact with each other, and the part from the midpoint 1*cd* to the vertex 1*c* and the part from the midpoint 1*cd* to the vertex 1*d* are in contact with each other, and the peripheral parts 1A, 1A may have their halves overlapped on each other. In this manner, the connecting members 4*a* and 4*b* (or 4*c* and 4*d*) may be hidden and protected. Note that the peripheral part 1A may be provided only at one of the two short sides.

The tent sheet according to the embodiment of the present invention is explained above. However, the present invention is not limited to the tent sheet described in the embodiment. Various design changes are possible within the scope of the matters described in the claims.

The tent 6 may include a plurality of tent sheets 1. For example, two of the tent sheets 1 in the state shown in FIGS. 3A, 3B, and 3C (or FIGS. 6A, 6B, and 6C) may be placed upon each other or the tent sheet 1 in the state shown in FIGS. 3A, 3B, and 3C may be placed upon the tent sheet 1 in the state shown in FIGS. 6A, 6B, and 6C to form a so-called double-wall tent. Alternatively, two of the tent sheets 1 in the state shown in FIGS. 3A, 3B, and 3C (or FIGS. 6A, 6B, and 6C) may be placed upon each other and slid such that the central tension reinforcement folding line parts 3 are overlapped and extended to form a long tent.

What is claimed is:

1. A tent sheet in a rectangular shape having four vertices, two short sides, and two long sides, the tent sheet comprising:

a straight-line diagonal tension reinforcement folding line part provided corresponding to each of the four vertices, the diagonal tension reinforcement folding line part being provided to extend from a midpoint of a short side adjacent to a corresponding vertex of the vertices to a vertex side point and being reinforced with a reinforcement member, wherein the vertex side point is nearer to a corresponding vertex than a midpoint of a long side adjacent to the corresponding vertex; and a straight-line central tension reinforcement folding line part, the straight-line central tension reinforcement folding line part being formed by connecting the midpoints of the two short sides and being reinforced with a reinforcement member;

wherein, when a tent having the tent sheet is set up by folding at the four diagonal tension reinforcement folding line parts and the central tension reinforcement folding line part, the tent sheet has a trapezoidal shape in a front view in which the lower base is shorter than the upper base, and a triangular shape in a left side view and a right side view.

2. The tent sheet according to claim 1, wherein a distance from the midpoint of the short side adjacent to the vertex corresponding to the diagonal tension reinforcement folding line part to the vertex is longer than a distance from the vertex side point of the long side adjacent to the vertex to the vertex.

3. The tent sheet according to claim 2, further comprising:

a straight-line transverse tension reinforcement folding line part, the transverse tension reinforcement folding line part being provided on a line connecting two of the vertex side points.

4. The tent sheet according to claim 2, further comprising:

a peripheral part which is symmetric with respect to the midpoint of the short side and is provided outward from the short side.

5. The tent sheet according to claim 1, wherein an additional diagonal tension reinforcement folding line part is provided corresponding to each of the four vertices, wherein a vertex side point of the additional diagonal tension reinforcement folding line part is located at a position different from the vertex side point of the diagonal tension reinforcement folding line part.

6. The tent sheet according to claim 5, further comprising:

a straight-line transverse tension reinforcement folding line part, the transverse tension reinforcement folding line part being provided on a line connecting two of the vertex side points.

7. The tent sheet according to claim 5, further comprising:

a peripheral part which is symmetric with respect to the midpoint of the short side and is provided outward from the short side.

8. The tent sheet according to claim 2, wherein an additional diagonal tension reinforcement folding line part is provided corresponding to each of the four vertices, wherein a vertex side point of the additional diagonal tension reinforcement folding line part is located at a position different from the vertex side point of the diagonal tension reinforcement folding line part.

9. The tent sheet according to claim 8, further comprising:

a straight-line transverse tension reinforcement folding line part, the transverse tension reinforcement folding line part being provided on a line connecting two of the vertex side points.

10. The tent sheet according to claim 1, further comprising:

a straight-line transverse tension reinforcement folding line part, the transverse tension reinforcement folding line part being provided on a line connecting two of the vertex side points.

11. The tent sheet according to claim 10, further comprising:

a peripheral part which is symmetric with respect to the midpoint of the short side and is provided outward from the short side.

12. The tent sheet according to claim 1, further comprising:

a peripheral part which is symmetric with respect to the midpoint of the short side and is provided outward from the short side.

* * * * *